United States Patent [19]

Garnier

[11] 3,997,933

[45] Dec. 21, 1976

[54] DEVICE FOR CLEARING TRAYS OF COLLECTIVITY RESTAURANTS BEFORE WASHING THEM

[76] Inventor: Patrice Garnier, Latreamont, 76360 Barentin, France

[22] Filed: Nov. 10, 1975

[21] Appl. No.: 630,170

[52] U.S. Cl. ..... 15/102; 15/56; 15/77; 214/301; 214/302; 214/309

[51] Int. Cl.[2] ..... A47L 15/24

[58] Field of Search ..... 15/3.17, 56, 74, 77, 15/93 R, 102; 214/301, 302, 309; 198/229, 230

[56] References Cited

UNITED STATES PATENTS

| | | | |
|---|---|---|---|
| 1,031,186 | 7/1912 | Laplace | 15/74 |
| 1,691,181 | 11/1928 | Coats et al. | 15/93 R |
| 2,650,178 | 8/ 1953 | Martin et al. | 15/102 |
| 2,651,065 | 9/1953 | O'Connor | 15/77 |
| 2,817,862 | 12/1957 | Frazho et al. | 15/102 |
| 2,975,920 | 3/1961 | Reed et al. | 15/309 |
| 3,795,335 | 3/1974 | Hansen | 214/302 |

*Primary Examiner*—Richard E. Aegerter
*Assistant Examiner*—John W. Shepperd

[57] ABSTRACT

A device for cleaning the trays of collectivity restaurants and the like before washing them comprises a two-section endless conveyor forming a gap therebetween, and, disposed in this gap, an endless chain conveyor comprising lugs for driving the trays delivered from the first section towards the other section and, laterally of said chain conveyor, a pair of fixed sideways adapted to engage the marginal portions of the trays. Fixed doctors are provided between said slideways for engaging the bottom of each tray and thus clear any wastes and garbage therefrom.

A hopper is provided under the endless chain for directing the wastes and garbage into a collecting vessel or the like.

6 Claims, 6 Drawing Figures

DEVICE FOR CLEARING TRAYS OF COLLECTIVITY RESTAURANTS BEFORE WASHING THEM

BACKGROUND OF THE INVENTION

FIELD OF THE INVENTION

The present invention relates to the cleaning of trays put at the users' disposal in collectivity restaurants or the like.

When these trays are abandoned by their users, they must be cleared of their contents before they can be delivered to the washer. Now, at that time, they carry both plates and dishes, glassware and fork-and-spoons, and also wastes or garbage. After withdrawing the recoverable objects the wastes and garbage can be disposed together with certain other articles such as cardboard or plastic tumblers and dishes.

It is therefore the essential object of the present invention to provide a device for clearing trays in collectivity restaurants or the like of any objects and garbage or wastes for subsequent disposal. This device is so designed that this clearing operation takes place along the path followed by the trays towards the machine in which they are washed.

SUMMARY OF THE INVENTION

To this end, the present invention is directed to a cleaning device adapted to clear wastes and garbage left on the trays of collectivity restaurants or the like before washing these trays. This operation is carried out by means of at least one doctor disposed across and above the tray guideways. This device is characterized in that said guideway comprises a pair of fixed lateral slideways adapted to carry the lateral edges of the trays and inclined upwards in the direction of travel of the trays, adequate means being provided overhead for driving the trays. Furthermore, a hopper for receiving the articles and wastes or garbage to be removed is provided under the cleaning doctor. However, other features and advantages of the device of this invention will appear as the following description proceeds with reference to the attached drawings.

DETAILED DESCRIPTION OF THE PREFERRED EMBODIMENT

Figure 1:
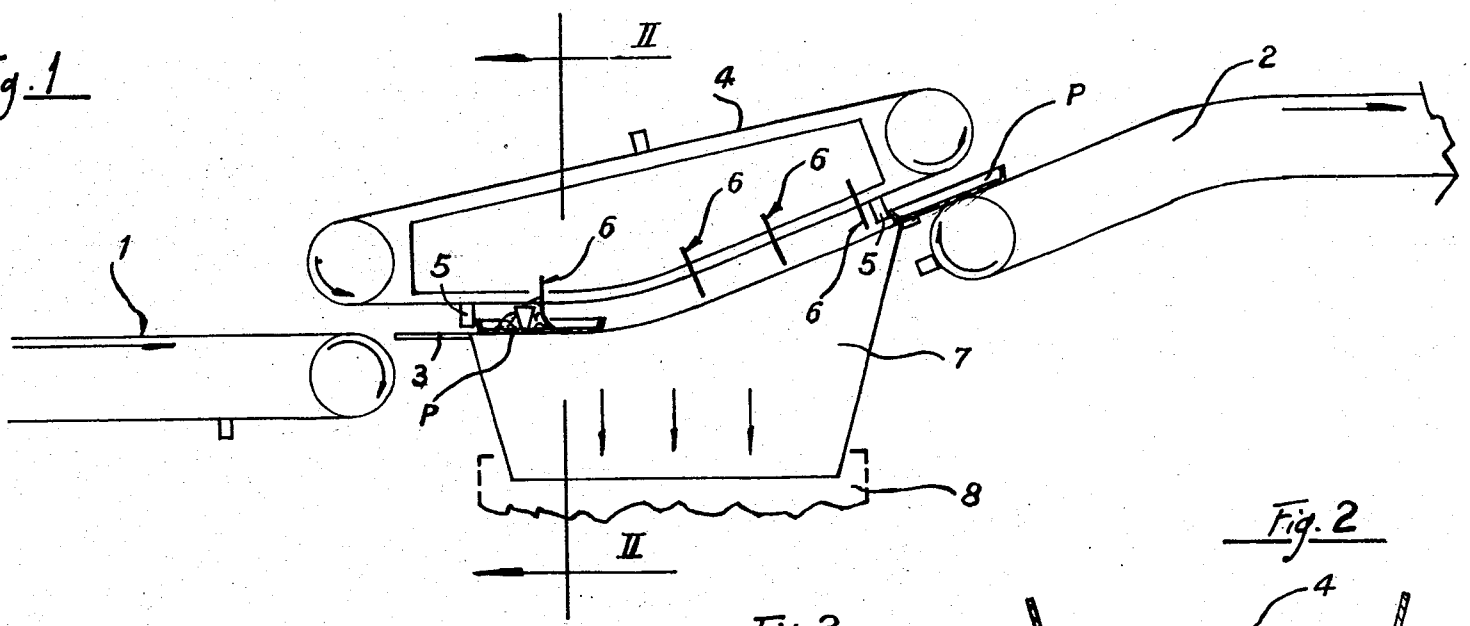
FIG. 1 is a diagrammatic longitudinal section showing a first form of embodiment of the device of this invention.

The device according to this invention is adapted to be interposed along the path followed by the trays to be cleaned as they are directed to a washer or like cleaning installation. This device may be interposed for instance between two conveyor sections 1 and 2, of which section 2 leads to the relevant washer or washing installation.

As already mentioned hereinabove, this device comprises a guideway consisting of a pair of parallel lateral slideways 3 adapted to support the marginal portions of the trays P to be treated. These slideways provide therebetween a free gap through which the garbage and other articles or objects removed from the trays for disposal can be dropped in a manner to be disclosed presently.

Above this guideway a tray driving system is provided. This system comprises an endless chain 4 to which external projecting catch-pins or lugs 5 are secured. The arrangement is such that along the path followed by the lower run of this chain the lugs or catch-pins 5 can engage and carry along the various trays P transferred from the first coneyor section 1 to the guideway 3. The trays P are retained at the outlet end of said first conveyor section 1 by a device controlling their transfer to said guideway 3.

The slideways 3*a* and 3*b* constituting said guideway 3 are inclined upwardly in order to raise the leading edge of each tray P, whereby the empty trays can subsequently be transferred to the other section 2 feeding a washer (not shown).

At an intermediate point selected along the conveyor 4 the device comprises one or a plurality of transverse cleaning doctors 6 or like scraping blades. Thus, in the example illustrated in FIGS. 1 and 2, four such doctors are provided at suitable intervals. The function of these doctors 6 is to retain the objects and garbage still adhering to the top surface of trays P. Consequently, these objects and garbage are caused to clear the free gap left between the pair of lateral parallel slideways 3 and fall into a receiving hopper 7 overlying a suitable container 8 for disposal.

The doctors 6 may be made of rigid or semi-rigid material. If a plurality of doctors are contemplated, their relative arrangement may differ from the one illustrated in FIG. 1.

Figure 5:
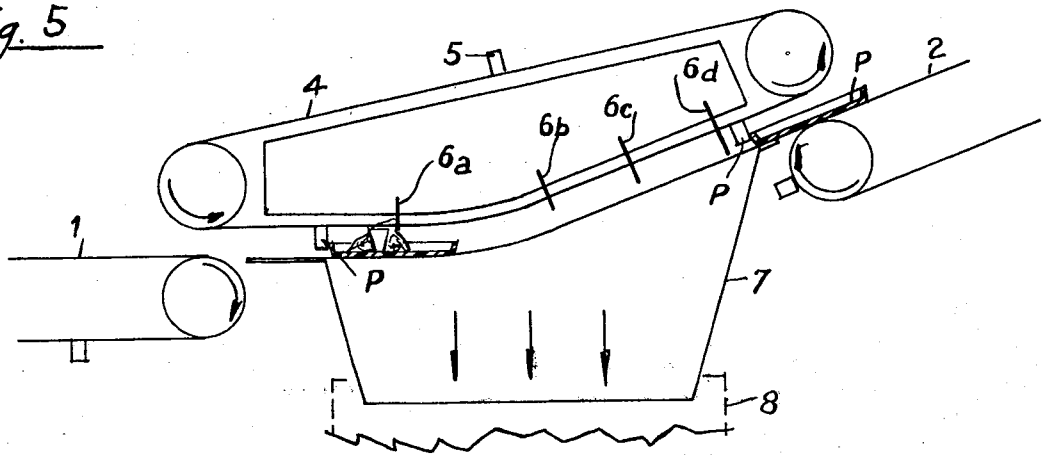
FIG. 5 is a longitudinal section illustrating another modified form of embodiment of the device.

Thus, as shown in FIG. 5, the first doctor 6*a* may be so positioned and have such dimensions as to leave a certain gap between its lower edge and the bottom of each tray P in order to retain only certains objects left thereon, for instance tumblers to be thrown away for disposal.

The following doctors 6*b* and 6*c* may leave a shallower gap between their lower edges and the bottom of tray P in order to retain the other objects, and may consist if desired of stiffer material.

On the other hand, the last doctor 6*d* consists preferably of flexible material so that its lower edge can engage the marginal portions of trays P to remove any garbage or objects left thereon after the passage of the preceding doctors.

Of course, the number of doctors may vary according to the type of objects to be removed or cleared, and also to the shape of the trays implemented.

Figure 2:
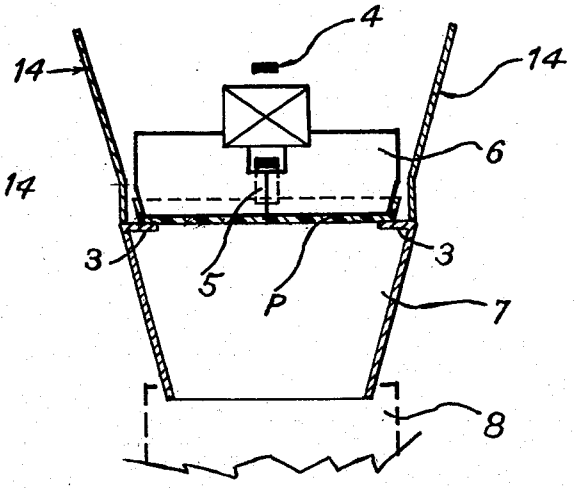
FIG. 2 is a cross section taken along the line 11-11 of FIG. 1.
Figure 3:
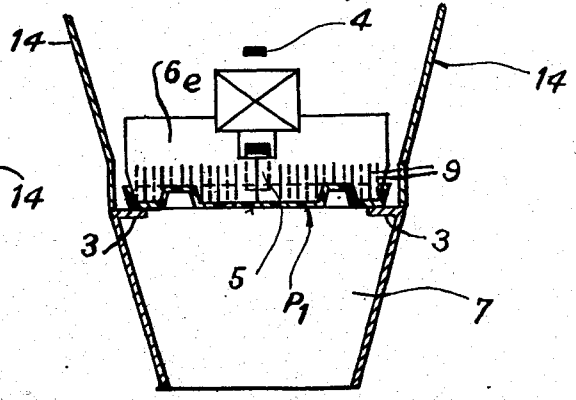
FIGS. 3 and 4 are views similar to FIG. 2 but showing modified forms of embodiment.

In the case of rectangular, flat-bottomed and non-recessed trays, imperforate or plain doctors 6 may be used (FIG. 2). On the other hand, in the case of trays P1 comprising a recessed bottom the use of doctors 6*e* (FIG. 3) formed with spaced vertical slits 9 in their lower portion may prove more convenient. Thus, some of the tabs formed by these slits can engage the bottom of the tray recesses to clear same of their contents.

Figure 4:
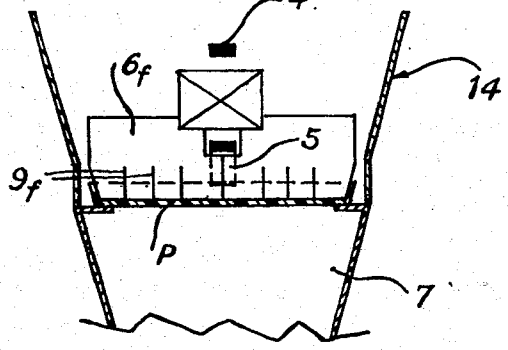

However, as illustrated in FIG. 4, it is also possible to use doctors 6*f* having a smaller number of slits 9*f*, for example for cleaning trays having cut-off corners.

Preferably, the cleaning doctors are held in position by fastening means permitting the replacement of worn doctors. However, these fastening means may also be designed with a view to permit the vertical adjustment of the doctors.

By virtue of its specific design and construction, it is possible with the cleaning device according to this invention to clear the trays of any objects and/or garbage left thereon, after the removal therefrom of dishes, plates, glassware and other articles to be washed in the dishwasher. Thus, when these trays P emerge from the device they are free of all their contents and can be transferred by the second conveyor section 2 leading to a washing machine or installation.

It will be seen that the provision of a pair of parallel lateral slideways 3 inclined upwardly in the direction of travel of the trays, as exemplified in FIGS. 1 and 5, has a twofold function:

Firstly, lifting the leading edge of each tray so that the tray can subsequently be laid upon the second conveyor section 2 leading to a washer;

Secondly facilitating the cleaning of the trays themselves and more particularly the fall of garbage and other objects possibly retained on the tray, by means of the cleaning doctor or doctors.

In fact, due to the rising of the trays on the guideway the gravity exerted on the garbage or other objects retained by the doctors tends to accelerate their backward fall into the gap left between the two guiding slideways, this action occurring immediately as the trays have begun their upward travel. Any garbage and other objects thus retained will therefore fall into the receiving hopper provided to this end.

To prevent the projection of wastes to the outside, side protection plates 14 are provided on both sides. This type of protection is also provided in the preceding form of embodiment illustrated in FIGS. 1–4.

Figure 6:
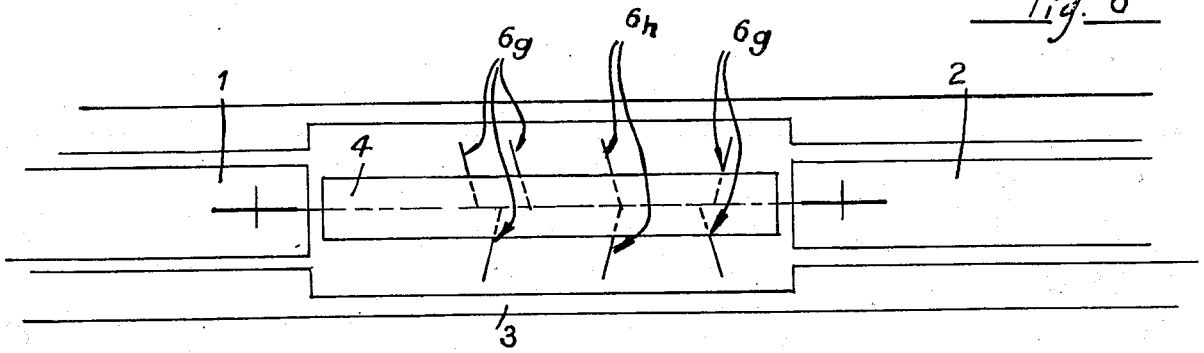
FIG. 6 is a plan view from above showing a modified arrangement of the cleaning doctors.

In the above-described forms of embodiment the cleaning doctors are disposed at right angles to the path of trays P. However, these doctors could as well be more or less inclined by one or the other side, and alternatively they could extend along only one portion of the tray width, provided that other complementary doctors extend along the remaining portion of the tray width. Besides, an arrangement of this kind is illustrated in FIG. 6 wherein some doctors **6*g* extend along one fraction only of the tray width with a certain inclination on one or the other side. However, another pair of doctors 6*h*** inclined in opposite directions are assembled in edge to edge relationship to form a continuous, V-shaped scraping unit. Of course, many other arrangements may be contemplated for the cleaning doctors without departing from the basic principle of the invention.

It is thought that the invention and its attendant advantages will be understood from the foregoing description and it will be apparent that various changes may be made in the form, construction and arrangement of the parts of the device described without departing from the spirit and scope of the invention or sacrificing all of its material advantages, the forms hereinabove described being merely preferred embodiments thereof.

Having thus described the invention, what is claimed as new is:

1. Cleaning device for clearing the trays of collectivity restaurants or the like of any wastes and garbage before washing the trays, which includes a first endless belt conveyor section adapted to receive the trays to be cleaned, a second endless belt conveyor section adapted to receive the trays after the cleaning thereof, said other conveyor section being dispoed at the exit end of, in alignment with, somewhat spaced from, and at a higher level than, said first conveyor section, with the upper run of both conveyor sections moving in the same direction, cleaning unit disposed between, and overlying, the exit end of said first conveyor section and the input end of said other conveyor section, said cleaning unit comprising an endless chain of which the bottom run travels in the direction from said first conveyor section to said other conveyor section, lugs on said endless chain for driving the trays delivered from said first conveyor section to said other conveyor section, and fixed means independent of said endless chains for engaging the wastes and garbage on said trays and clearing the trays thereof as said trays move past said fixed means, fixed guideways disposed on either side of said endless chain lower run and comprising a pair of lateral slideways adapted to carry the marginal portions of said trays and inclined upwardly in the direction of travel thereof, and a hopper underlying the lower run of the endless chain for collecting the wastes and garbage detached from the trays by said waste and garbage engaging means of said endless chain.

2. Cleaning device as recited in claim 1, wherein said wastes and garbage engaging means comprise doctors disposed across the path followed by said trays.

3. Cleaning device as recited in claim 2, wherein a plurality of slits are formed in the lower edge of each doctor.

4. Cleaning device as recited in claim 2, wherein said doctors are disposed at suitable intervals from, and behind, one another, the rearmost doctor engaging the bottom of the trays while the other doctors have their lower edges more or less spaced from the tray bottom, the gap thus left decreasing from the first doctor to the last doctor of the series.

5. Cleaning device as recited in claim 4, wherein at least some of said doctors extend along one fraction of the tray width, the other occupying the remaining portion of said width.

6. Cleaning device as recited in claim 4, wherein side plates or like baffle means are provided to prevent the projection of wastes or garbage in a direction other than that leading to said hopper.

* * * * *

UNITED STATES PATENT AND TRADEMARK OFFICE

CERTIFICATE OF CORRECTION

PATENT NO. : 3,997,933

DATED : December 21, 1976

INVENTOR(S) : Patrice Garnier

It is certified that error appears in the above-identified patent and that said Letters Patent are hereby corrected as shown below:

In the heading, insert the name and address of the Assignee as follows:

CIDELCEM, France

Signed and Sealed this

Seventeenth Day of May 1977

[SEAL]

*Attest:*

RUTH C. MASON
*Attesting Officer*

C. MARSHALL DANN
*Commissioner of Patents and Trademarks*